US007829160B2

(12) United States Patent
Schultz et al.

(10) Patent No.: US 7,829,160 B2
(45) Date of Patent: Nov. 9, 2010

(54) GLOSSY INKJET RECORDING ELEMENT ON ABSORBENT PAPER

(75) Inventors: Terry C. Schultz, Hilton, NY (US); Lori J. Shaw-Klein, Rochester, NY (US); Thomas P. Nicholas, Rochester, NY (US); Kenneth J. Ruschak, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 803 days.

(21) Appl. No.: 11/364,748

(22) Filed: Feb. 28, 2006

(65) Prior Publication Data

US 2007/0202278 A1 Aug. 30, 2007

(51) Int. Cl.
*B41M 5/50* (2006.01)

(52) U.S. Cl. ..... 428/32.15; 428/32.25; 428/32.24

(58) Field of Classification Search ..... None
See application file for complete search history.

(56) References Cited

U.S. PATENT DOCUMENTS

| | | | | |
|---|---|---|---|---|
| 5,447,753 | A | 9/1995 | Noda et al. | |
| 5,643,631 | A | 7/1997 | Donigian et al. | |
| 6,447,111 | B1 | 9/2002 | Gallo et al. | |
| 6,511,736 | B1 | 1/2003 | Asano et al. | |
| 6,630,212 | B2 | 10/2003 | Bermel et al. | |
| 6,689,430 | B2 | 2/2004 | Sadasivan et al. | |
| 6,979,480 | B1 * | 12/2005 | Schulz et al. | 428/32.17 |
| 7,316,473 | B2 | 1/2008 | Matsuzawa et al. | |
| 7,425,246 | B2 | 9/2008 | Urscheler | |
| 2003/0138604 | A1 * | 7/2003 | Landry-Coltrain et al. | 428/195 |
| 2003/0162009 | A1 | 8/2003 | Cuch et al. | |
| 2004/0152819 | A1 | 8/2004 | Cuch | |
| 2005/0191441 | A1 | 9/2005 | Yajamoto et al. | |
| 2005/0196559 | A1 | 9/2005 | Nishio et al. | |
| 2007/0202264 | A1 | 8/2007 | Ruschak et al. | |
| 2007/0202279 | A1 | 8/2007 | Schultz et al. | |

FOREIGN PATENT DOCUMENTS

| | | |
|---|---|---|
| EP | 1 249 533 | 10/2002 |
| EP | 1 580 016 | 9/2005 |

* cited by examiner

*Primary Examiner*—D. Lawrence Tarazano
*Assistant Examiner*—Gregory Clark
(74) *Attorney, Agent, or Firm*—Chris P. Konkol; Andrew J. Anderson

(57) ABSTRACT

An inkjet recording element comprising an absorbent support, a porous base layer nearest the support and comprising precipitated calcium carbonate, a porous ink-receiving intermediate layer above the base layer and comprising hydrated alumina, and a porous ink-receiving upper layer above the intermediate layer and comprising a mixture of hydrated and fumed alumina. Also disclosed is an advantageous method of making such inkjet recording materials.

25 Claims, No Drawings

GLOSSY INKJET RECORDING ELEMENT ON ABSORBENT PAPER

CROSS-REFERENCE TO RELATED APPLICATIONS

The present application is related to U.S. application Ser. No. 11/364,749, filed on the same date hereof by Schultz et al., and entitled, "GLOSSY INKJET RECORDING ELEMENT ON ABSORBENT PAPER AND CAPABLE OF ABSORBING HIGH INK FLUX" and to U.S. application Ser. No. 11/364,712, filed on the same date hereof, by Ruschak et al., and entitled "METHOD FOR MAKING A HIGH-INK-FLUX GLOSSY COATED INKJET RECORDING ELEMENT ON ABSORBENT PAPER," hereby incorporated by reference in their entirety.

FIELD OF THE INVENTION

The invention relates generally to the field of inkjet recording media and printing methods. More specifically, the invention relates to a porous inkjet recording element comprising an absorbent paper support and capable of both absorbing a high ink flux and providing a glossy surface.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of an aqueous mixture, for example, comprising water and one or more organic materials such as a monohydric alcohol, a polyhydric alcohol, or the like.

An inkjet recording element typically comprises a support having on at least one surface thereof at least one ink-receiving layer. There are generally two types of ink-receiving layers (IRL's). The first type of IRL comprises a non-porous coating of a polymer with a high capacity for swelling, which non-porous coating absorbs ink by molecular diffusion. Cationic or anionic substances may be added to the coating to serve as a dye fixing agent or mordant for a cationic or anionic dye. Typically, the support is a smooth resin-coated paper and the coating is optically transparent and very smooth, leading to a very high gloss "photo-grade" inkjet recording element. However, this type of IRL usually tends to absorb the ink slowly and, consequently, the imaged receiver or print is not instantaneously dry to the touch.

The second type of ink-receiving layer or IRL comprises a porous coating of inorganic, polymeric, or organic-inorganic composite particles, a polymeric binder, and optional additives such as dye-fixing agents or mordants. These particles can vary in chemical composition, size, shape, and intra-particle porosity. In this case, the printing liquid is absorbed into the open interconnected pores of the IRL, substantially by capillary action, to obtain a print that is instantaneously dry to the touch. Typically the total interconnected inter-particle pore volume of porous media, which may include one or more layers, is more than sufficient to hold all the applied ink forming the image.

Basically, organic and/or inorganic particles in a porous layer form pores by the spacing between the particles. The binder is used to hold the particles together. However, to maintain a high pore volume, it is desirable that the amount of binder is limited. Too much binder would start to fill the pores between the particles or beads, which would reduce ink absorption. On the other hand, too little binder may reduce the integrity of the coating, thereby causing cracking. Once cracking starts in an inkjet coating, typically at the bottom of the layer, it tends to migrate throughout the layer.

A porous inkjet recording medium that is glossy usually contains at least two layers in addition to the support: a base layer nearer to the support and a glossy image-receiving layer further from the support. One method of obtaining a "photographic-grade" gloss is to coat the inkjet receiving layers on a resin-coated paper support. Resin-coated paper support is relatively costly, however, and requires an extra resin-coating step in its manufacture.

For example, Bermel et al., U.S. Pat. No. 6,630,212, describes an inkjet recording medium comprising two porous layers coated on a resin-coated support paper. The two layers are coated simultaneously by a pre-metering method, extrusion hopper coating, on a polyethylene resin-coated support paper. The base-layer coating composition comprises fumed alumina particles, PVA binder, and coating aids at a solids content of 30%. The coated weight of the base layer is 43 $g/m^2$. An image-receiving layer over the base layer comprises fumed alumina particles, cationic polymeric latex dispersion, and PVA binder. The coated weight of the IRL is 2.2 $g/m^2$.

Inkjet, recording media with "photographic-grade" gloss can also be made when coating on a plain paper support. Because plain paper supports are generally rougher or less smooth than resin-coated paper supports, however, it is typically necessary to use special coating processes, such as cast coating or film transfer coating in order to achieve a smooth, glossy surface on the image receiving layer. These specialized coating methods are constrained in their productivity by drying considerations or by extra steps. Mild calendering with heat and pressure has also been used in combination with conventional blade, rod, or air-knife coating processes on plain paper in order to produce a glossy surface on the image-receiving layer, but these approaches tend to result in lower levels of gloss and smoothness than usually obtained for coatings on resin coated paper supports.

For example, a porous two-layer inkjet receiving material coated on plain paper support is described by Sadasivan et al., in U.S. Pat. No. 6,689,430. The inkjet recording element comprises a base layer coated from a composition at a solids level of 35% to form a layer with a dry weight of 27 $g/m^2$. The base layer comprises inorganic pigments, namely precipitated calcium carbonate (PCC) and silica gel, and binders, namely polyvinyl alcohol and styrene-butadiene latex. One of the main functions of the base layer is to provide a sump for the ink fluids in the applied ink as compared to the colorant, whether dye or pigment-based. The image-receiving layer is coated over the dried base layer in the amount of 8.6 $g/m^2$ using a coating composition of 15% solids comprising a mixture of colloidal alumina and fumed alumina particles, PVA binder, cationic polymeric latex dispersion, and coating aids. The inkjet recording element disclosed by Sadasivan et al., while providing good image quality and adequate gloss at moderate ink fluxes, is inadequate for higher printing speeds now demanded and is not as glossy as desired.

As the quality and density of inkjet images increases, so does the amount of ink applied to the inkjet recording element (also referred to as the "receiver"). For this reason, it is important provide sufficient void capacity in the medium to prevent puddling or coalescence and inter-color bleed. At the same time, print speeds are increasing in order to provide convenience to the user. Thus, not only is sufficient capacity required to accommodate the increased amount of ink, but in addition, the medium must be able to handle increasingly greater ink flux in terms of ink volume/unit area/unit time.

Porous glossy inkjet receiver materials that are commercially available at present generally comprise less than 50 g/m$^2$ of porous ink-absorbing (or "ink-retaining") layers and there is a limit to the ink fluxes that they can handle without a loss in image quality. The cost of high weight coatings using the materials, comprising fumed alumina, employed in the above-described example of U.S. Pat. No. 6,630,212 to Bermel et al. would be prohibitive in amounts beyond 50 g/m$^2$. In addition, coating compositions comprising such materials thicken at high concentrations. On the other hand, coating of dilute compositions to achieve high weight coatings would require long driers, slower coating rates or multiple coating passes, all of which increase costs of facilities, energy, and/or labor and reduce productivity. Thus, the amount of ink absorbing material used in inkjet recording elements is currently limited as a matter of practice, in that the advantages of higher overall capacity of the coatings is outweighed by certain manufacturing problems and costs. In addition, it has not been demonstrated that high gloss can be obtained in porous inkjet recording elements without relatively expensive materials, or complicated or disadvantageous manufacturing processes. For example, inkjet media having base layers comprising calcium carbonate do not provide gloss and uniformity comparable with that of layers comprising mainly metallic oxide particles. Even with more expensive materials such as boehmite in the base layer, resin coated paper has been needed for high gloss.

In view of the above, the manufacture of high quality, high capacity, high gloss porous inkjet receiver materials has been complicated by multilayer structures, high coated weights of one or more layers, and relatively expensive materials or complicated processes.

Cuch, in US patent application publication 2004/0152819, describes a coating composition for preparing the undercoat of a glossy inkjet receiving material, comprising a mixture of 0 to 20% silica pigment and 80 to 100% fumed metallic oxide pigment. The receiver material may further comprise an optional overcoat comprising a mixture of 20 to 99% silica pigment and 1 to 80% fumed metallic oxide pigment, wherein the ratio of fumed metallic oxide to silica particles ranges from 1:200 to 4:1 Cuch teaches that the fraction of pigment comprising fumed metallic oxide should be greater in the undercoat than in the overcoat in order to obtain higher gloss. The layers are coated on either a paper support or a resin-coated paper which may have a smoothing layer prepared with a silica/calcium-carbonate pigment composition. The overall laydowns used by Cuch in the examples were less than 50 g/m$^2$. The gloss levels depended on the base paper used among other factors, but unless specially calendered paper of high smoothness was used, the gloss at 60° was typically less than 50.

PROBLEM TO BE SOLVED BY THE INVENTION

It is therefore an object of the present invention to provide inkjet recording media that simultaneously provides excellent photographic image quality, exhibits high gloss on absorbent paper, provides a fast dry time, and is capable of providing excellent image quality.

It is yet a further object of this invention to provide a method of printing employing the inkjet recording media.

SUMMARY OF THE INVENTION

The present invention is directed to overcoming one or more of the problems set forth above. It is an object of this invention to provide an image recording element with high gloss on absorbent paper and fast drying time. It is a further object of this invention to provide a printing method for printing on an inkjet recording element wherein the element is capable of being providing for high flux and a fast dry time.

These and other objects are achieved in accordance with the invention, which comprises an inkjet recording element comprising an absorbent support, a porous base layer nearest the support, a porous ink-receiving intermediate layer above the base layer, and a porous ink-receiving upper layer above the intermediate layer, wherein based on dry weight coverages, the base layer, optionally comprising one or more sub-layers, is present in an amount of 25 g/m$^2$ to 60 g/m$^2$, the intermediate layer, optionally comprising one or more sub-layers, is present in an amount of 25 g/m$^2$ to 60 g/m$^2$, and the upper layer is present in an amount of 1 to 10 g/m$^2$. Preferably, the upper layer comprises most of the mordant in the inkjet media at a relatively high concentration, optionally the sole layer with mordant, preferably in the form of a cationic polymer, preferably also polymeric latex.

Accordingly, one aspect of the present invention relates to an inkjet recording element comprising, in order over an absorbent support:

(a) a porous base layer comprising a polymeric binder and at least 80 percent by weight of inorganic particles, wherein at least 60% by weight of the inorganic particles comprises precipitated calcium carbonate having a particle size of 0.4 to 5 micrometers;

(b) a porous ink-receiving intermediate layer comprising at least 80 percent by weight of inorganic particles of hydrated or unhydrated alumina, the median primary particle size of which is between 150 and 250 nm, wherein the concentration of fumed alumina in the intermediate layer, if present, is less than the concentration of fumed alumina in the upper layer, relevant to the inorganic particles in each layer; and (c) a porous image-receiving upper layer comprising at least 80 percent, by weight of total inorganic particles, of an admixture of fumed alumina particles and aluminum oxyhydroxide particles, wherein the latter particles have a median particle size of from about 90 to 150 nm and the former particles have a median secondary particle size of 200 nm and primary average particle size of 7 to 40 nm;

wherein, based on dry weight coverages, the base layer, optionally comprising divided into sub-layers, is present in an amount of 25 g/m$^2$ to 60 g/m$^2$, the intermediate layer, optionally divided into sub-layers, is present in an amount of 15 g/m$^2$ to 60 g/m$^2$, the upper layer is present in an amount of 1 to 10 g/m$^2$;

and wherein the unprinted inkjet recording element exhibits a 20-degree gloss of at least 15 Gardner gloss units.

The first materials and second materials are different, although the materials in the upper and intermediate layer can be the same although at least differing in terms of particle size and relative amounts.

Another aspect of the present invention relates to a printing method employing an inkjet recording element according to the present invention.

In describing the invention herein, the following definitions generally apply:

The term "porous layer" is used herein to define a layer that is characterized by absorbing applied ink by means of capillary action rather than liquid diffusion. The porosity is based on pores formed by the spacing between particles, although porosity can be affected by the particle to binder ratio. The porosity of a layer may be predicted based on the critical pigment volume concentration (CPVC). An inkjet recording element having one or more porous layers, preferably substantially all layers, over the support can be referred to as a "porous inkjet recording element," even though at least the support is not considered porous.

Particle sizes referred to herein, unless otherwise indicted, are median particle sizes as determined by light scattering measurements of diluted particles dispersed in water, as measured using laser diffraction or photon correlation spectroscopy (PCS) techniques employing NANOTRAC (Microtac Inc.), MALVERN, or CILAS instruments or essentially equivalent means, which information is often provided in product literature. For particle sizes greater than 0.3 micrometers, particle measurements are by a Micromeritics SediGraph® 5100 or equivalent means. For particle sizes not more than about 50 nm, particle measurements are by direct methods, transmission electron microscopy (TEM) of a representative sample or equivalent means. Unless otherwise indicated particle sizes refer to secondary particle size.

As used herein, the terms "over," "above," "upper," "under," "below," "lower," and the like, with respect to layers in inkjet media, refer to the order of the layers over the support, but do not necessarily indicate that the layers are immediately adjacent or that there are no intermediate layers.

In regard to the present method, the term "image-receiving layer" is intended to define a layer that is used as a pigment-trapping layer, dye-trapping layer, or dye-and-pigment-trapping layer, in which the printed image substantially resides throughout the layer. Preferably, an image-receiving layer comprises a mordant for dye-based inks. In the case of a dye-based ink, the image may optionally reside in more than one image-receiving layer.

In regard to the present method, the term "base layer" (sometimes also referred to as a "sump layer" or "ink-carrier-liquid receptive layer") is used herein to mean a layer under at least one other ink-retaining layer that absorbs a substantial amount of ink-carrier liquid. In use, a substantial amount, preferably most, of the carrier fluid for the ink is received in the base layer. The base layer is not above an image-containing layer and is not itself an image-containing layer (a pigment-trapping layer or dye-trapping layer). Preferably, the base layer is the ink-retaining layer nearest the support and comprises calcium carbonate.

The term "ink-receptive layer" or "ink-retaining layer" includes any and all layers above the support that are receptive to an applied ink composition, that absorb or trap any part of the one or more ink compositions used to form the image in the inkjet recording element, including the ink-carrier fluid and/or the colorant, even if later removed by drying. An ink-receptive layer, therefore, can include an image-receiving layer, in which the image is formed by a dye and/or pigment, a base layer, or any additional layers, for example between a base layer and a topmost layer of the inkjet recording element. Typically, all layers above the support are ink-receptive. The support on which ink-receptive layers are coated may also absorb ink-carrier fluid, in which it is referred to as an ink-absorptive or absorbent layer rather than an ink-receptive layer.

The term "precipitated calcium carbonate" is used herein to define a synthetically produced calcium carbonate, not based on calcium carbonate found in nature.

The term "plain paper" refers to paper that has less than 1 g/m$^2$ of coating applied over raw paper. The term "raw paper" refers to cellulosic paper the surface of which does not have a continuous layer or coating of a separate material over the cellulose fibers of the paper, although the paper may treated with a sizing agent or may be impregnated with treatment materials over a portion of the surface.

DETAILED DESCRIPTION OF THE INVENTION

As indicated above, the present invention relates to porous inkjet recording element comprising, over an absorbent support, a porous base layer nearest the support, a porous ink-receiving intermediate layer above the base layer, and a porous ink-receiving upper layer above the intermediate layer, wherein based on dry weight coverages, the base layer is present in an amount of 25 g/m$^2$ to 60 g/m$^2$, preferably between 30 and 50 g/m$^2$, the intermediate layer is present in an amount of 15 g/m$^2$ to 60 g/m$^2$, preferably between 15 and 50 g/m$^2$, and the upper layer is present in an amount of 1 to 10 g/m$^2$, preferably 1 to 5 g/m$^2$, such that the total dry weight coverage of the base layer, the intermediate layer, and the upper layer is 60 to 130 g/m$^2$. The base and intermediate layers may optionally be divided into sub-layers, preferably immediately adjacent sub-layers, in which case independently the sub-layers individually and collectively meet the limitations of the layer. Preferably, if sub-divided, then only 2 or 3 sub-layers are present making up the layer.

In one preferred embodiment, intended for high flux printing, the base layer is present in an amount of between 30 and 50 g/m$^2$, the intermediate layer is present in an amount between 30 and 50 g/m$^2$, the upper layer is present in an amount of 1 to 5 g/m$^2$, and the total dry weight coverage of the base layer, the intermediate layer, and the upper layer is 61 to 105 g/m$^2$. In one such embodiment, the inkjet recording element consists essentially of the porous base layer, intermediate layer, and upper layer over the support, with the possible exception of layers less than 1 micrometer thick such as subbing layers.

In a preferred embodiment, the 60-degree gloss of the unprinted inkjet recording element is at least 40 Gardner gloss units, more preferably the 20-degree gloss is at least 20 Gardner gloss units and the 60-degree gloss is at least 50 Gardner gloss units, most preferably the 20-degree gloss is greater than 25 Gardner gloss units and the 60-degree gloss is greater than 55 Gardner gloss units.

In a preferred embodiment, the present inkjet recording media provides photographic image quality, exhibits a 200 Gardner gloss of at least 25 gloss units (in the unprinted media), and an ability to absorb an ink flux of at least $5.0\times10^{-4}$ mL/cm$^2$/sec without loss of image quality. This ink flux corresponds to printing a 4-inch by 6-inch photograph at an addressable resolution of 1200 by 1200 pixels per inch with an average ink volume of 10.35 picoliters (pL) per pixel in 42 seconds, wherein the printing of a given pixel by multiple coating passes is complete in less than 4 seconds.

The base layer comprises inorganic particles, for example, calcium carbonate, magnesium carbonate, insoluble sulfates (for example, barium or calcium sulfate), hydrous silica or silica gel, silicates (for example aluminosilicates), titanium dioxide, talc, and clay or constituents thereof (for example, kaolin or kaolinite). Preferred particles, for the bulk of the inorganic particles in the base layer, are structured pigments in which the dispersed particles have low or no internal porosity, as compared to microporous pigments. Structured pigments have a non-spherical morphology that does not allow dense packing in the dried coating. Precipitated calcium carbonate (PCC) is an example of a structured pigment that can provide high porosity in inkjet coatings. For example, precipitated calcium carbonate having scalenohedral morphology has been used to provide absorption of inkjet-printing inks.

The base layer preferably comprises between 50 percent and 90 percent by weight of the inorganic particles.

Although many types of inorganic or organic particles can be used in the base layer, calcium carbonate has been found to be an inexpensive particle that can still provide enough void capacity when coated on a substrate. As a base layer on plain paper, calcium carbonate provides a suitable substrate for developing gloss of the upper layer or layers by mild calendering. A moderate amount of silica gel up to 30% of the total weight of particles in the base layer may be used to increase porosity. Both calcium carbonate and silica gel are stable as preferably anionic particles coated at suitable pH.

Preferably, the base layer comprises particles of precipitated calcium carbonate and in one particularly preferred base layer, the particles of precipitated calcium carbonate make up at least 65 weight percent, based on the total inorganic particles in the base layer. The precipitated calcium carbonate can comprise scalenohedral, prismatic, acicular, or rhombohedral morphology, and combinations thereof.

In another embodiment, an admixture of two different precipitated calcium carbonate particles, of different morphologies, is advantageously employed in the base layer. More preferably, the base layer comprises an admixture of scalenohedral in combination with acicular and/or prismatic precipitated calcium carbonate, as disclosed in copending commonly assigned docket U.S. application Ser. No. 11/302,875, filed Dec. 14, 2005, hereby incorporated by reference.

In particular, in one embodiment, the base layer comprises a binder, preferably in an amount of 3 to 20 weight %, and at least 80% by weight of inorganic particles, wherein at least 60 percent, preferably at least 65 percent, more preferably at least 70 percent, by weight of the inorganic particles comprise precipitated calcium carbonate, preferably having an median particle size of 0.4 to 5 micrometers, preferably 0.5 to 1.5 micrometers, Examples of scalenohedral calcium carbonate that can be used include various ALBACAR PCC products available from Specialty Minerals Inc. (subsidiary of Minerals Technologies Inc.). Scalenohedral PCC materials available from Specialty Minerals include ALBACAR HO, ALBACAR 5970 and ViCALity® Extra Light.

Examples of other types of precipitated calcium carbonate include ALBAGLOS and ALBAFIL PCC's (prismatic), OPACARB PCC (acicular), and ViCALity® Heavy PCC (cubic), products also available from Specialty Minerals Inc. Other companies making PCC's include Pfizer and Solvay.

For use in a calcium-carbonate-containing layer, the average size (diameter or equivalent diameter), compared to median size, of the calcium carbonate particles (for each morphology) can suitably vary in length from 0.4 g/m to 5 μm, with a preferred size of less than 3 μm, more preferably less than 2 μm, most preferably about 0.4 to 2 μm.

In one preferred embodiment, base layer comprises precipitated calcium carbonate in admixture with up to 40 percent by weight of other particles, based on the total weight of inorganic particles, either organic and/or other inorganic particles, including organic-inorganic composite particles.

Examples of organic particles that may be used in the base layer include polymer beads, including but not limited to acrylic resins such as methyl methacrylate, styrenic resins, cellulose derivatives, polyvinyl resins, ethylene-allyl copolymers and polycondensation polymers such as polyesters. Hollow styrene beads are a preferred organic particle for certain applications.

Other examples of organic particles which may be used include core/shell particles such as those disclosed in U.S. Pat. No. 6,492,006 and homogeneous particles such as those disclosed in U.S. Pat. No. 6,475,602, the disclosures of which are hereby incorporated by reference.

Examples of inorganic particles that may be used in the base layer, for example, in addition to precipitated calcium-carbonate particles, include silica, alumina, titanium dioxide, clay, talc, calcined clays, calcium carbonate, barium sulfate, or zinc oxide. In one preferred embodiment, the calcium-carbonate-containing layer further comprises porous alumina or silica gel in a crosslinked poly(vinyl alcohol) binder.

In one preferred embodiment, the base layer comprises particle of silica gel in an amount of at least 5 percent, preferably 10 to 40 percent, more preferably 15 to 35, most preferably 20 to 28 percent by weight based on the total inorganic particles in the base layer.

In a preferred embodiment, the average primary particle size of the optional additional organic or inorganic particles is about 0.3 μm (300 nm) to about 5 μm, preferably 0.5 μm (500 nm) to less than 1.0 μm. A plurality of inorganic particles such as alumina may agglomerate into larger secondary particles. As mentioned above, smaller particles provide smaller capillaries, but tend to be more prone to cracking unless the particle to binder ratio is adjusted downward in view of the large surface area created by the particles. On the other hand, particles that are too large may be brittle or prone to cracking because of fewer contact points, for example, if the coating has a thickness equal to only a few beads making up the dried coating.

In a preferred embodiment of the invention, the base layer comprises between 75% by weight and 98% by weight of particles and between about 2% and 25% by weight of a polymeric binder, preferably from about 82% by weight to about 96% by weight of particles and from about 18% by weight to about 4% by weight of a polymeric binder, most preferably about 4 to 10% by weight of binder.

As mentioned above, the amount of binder is desirably limited, because when ink is applied to inkjet media, the (typically aqueous) liquid carrier tends to swell the binder and close the pores and may cause bleeding or other problems. Preferably, therefore, the base layer comprises less than 25 weight percent of binder, to maintain porosity, although higher levels of binder may be used in some cases to prevent cracking.

Any suitable polymeric binder may be used in the base layer of the inkjet recording element employed in the invention. In a preferred embodiment, the polymeric binder may be a compatible, preferably hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin. In general, good results are also obtained with polyurethanes, vinyl acetate-ethylene copolymers, ethylene-vinyl chloride copolymers, vinyl acetate-vinyl chloride-ethylene terpolymers, acrylic polymers, or derivatives thereof. Preferably, the binder is a water-soluble hydrophilic polymer, most preferably polyvinyl alcohol or the like.

Other binders can also be used such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like. A poly(styrene-co-butadiene) latex is preferred. Mixtures of hydrophilic and latex binders are useful, and a mixture of PVA with a poly(styrene-co-butadiene) latex is particularly preferred.

In order to impart mechanical durability to the base layer, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid or a borate salt and the like may be used. Preferably, the crosslinker is an aldehyde, an acetal or a ketal, such as 2,3-dihydroxy-1,4-dioxane.

The base layer is at least about 25 μm in thickness (dried), more preferably at about 30 μm or 70 μm, depending on the presence of other liquid-carrier absorbing layers, most preferably about 30 to 60 μm.

As indicated below, other conventional additives may be included in the base layer, which may depend on the particular use for the recording element. The base layer usually does not comprise a mordant.

The base layer is located under at least two other porous layers and absorbs a substantial amount of the liquid carrier applied to the inkjet recording element, but substantially less dye or pigment than the overlying layer or layers.

The porous layers above the base layer contains interconnecting voids that can provide a pathway for the liquid components of applied ink to penetrate appreciably into the base layer, thus allowing the calcium-carbonate-containing layer to contribute to the dry time. A non-porous layer or a layer that contains closed cells would not allow underlying layers to contribute to the dry time.

As indicated above, the inkjet recording element comprises, over the base layer, a porous ink-receiving intermediate layer comprising greater than 50 percent, by weight of the layer, of particles of one or more second materials having a median particle size less than 300 nm, preferably between 150 and 250 nm, wherein the intermediate layer, optionally divided into one or more sub-layers, is present in an amount of 15 $g/m^2$ to 60 $g/m^2$.

Preferably, the one or more second materials in the ink-receiving intermediate layer comprise particles of hydrated or unhydrated metallic oxide or non-metallic oxide. The preferred semi-metallic element is silicon. More preferably, the one or more second materials are substantially non-aggregated colloidal particles that comprise silica or hydrated or unhydrated alumina. Most preferably, the one or more materials comprise a hydrated alumina that is an aluminum oxyhydroxide material, for example, boehmite and the like.

Preferably the one or more second materials in the ink-receiving intermediate layer comprises from 75 to 100 percent of the inorganic particles in the ink-receiving intermediate layer.

The term "hydrated alumina" is herein defined by the following general formula:

$$Al_2O_{3-n}(OH)_{2n}.mH_2O$$

wherein n is an integer of 0 to 3, and m is a number of 0 to 10, preferably 0 to 5. In many cases, $mH_2O$ represents an aqueous phase which does not participate in the formation of a crystal lattice, but is able to be eliminated. Therefore, m may take a value other than an integer. However, m and n are not 0 at the same time.

The term "hydrated alumina" is herein defined by the above formula when m and n are both zero at the same time and includes fumed alumina, made in a dry phase process or anhydrous alumina $Al_2O_3$ made by calcining hydrated alumina. As used herein, such terms as unhydrated alumina apply to the dry materials used to make coating compositions during the manufacture of the inkjet recording element, notwithstanding any hydration that occurs after addition to water.

A crystal of the hydrated alumina showing a boehmite structure is generally a layered material the (020) plane of which forms a macro-plane, and shows a characteristic diffraction peak. Besides a perfect boehmite, a structure called pseudo-boehmite and containing excess water between layers of the (020) plane may be taken. The X-ray diffraction pattern of this pseudo-boehmite shows a diffraction peak broader than that of the perfect boehmite. Since perfect boehmite and pseudo-boehmite may not be clearly distinguished from each other, the term "boehmite" or "boehmite structure" is herein used to include both unless indicated otherwise by the context. For the purposes of this specification, the term "boehmite" implies boehmite and/or pseudoboehmite.

Boehmite and pseudoboehmite are aluminum oxyhydroxides which is herein defined by the general formula γ-AlO(OH) $xH_2O$, wherein x is 0 to 1. When x=0 the material is specifically boehmite as compared to pseudo-boehmite; when x>0 and the materials incorporate water into their crystalline structure, they are known as pseudoboehmite. Boehmite and pseudoboehmite are also described as $Al_2O_3.zH_2O$ where, when z=1 the material is boehmite and when $1 \leqq z \leqq 2$ the material is pseudoboehmite. The above materials are differentiated from the aluminum hydroxides (e.g. $Al(OH)_3$, bayerite and gibbsite) and diaspore (α-AlO(OOH) by their compositions and crystal structures. As indicated above, boehmite is usually well crystallized and, in one embodiment, has a structure in accordance with the x-ray diffraction pattern given in the JCPDS-ICDD powder diffraction file 21-1307, whereas pseudoboehmite is less well crystallized and generally presents an XRD pattern with relatively broadened peaks with lower intensities.

The term "aluminum oxyhydroxide" is herein defined to be broadly construed to include any material whose surface is or can be processed to form a shell or layer of the general formula γ-AlO(OH) $xH_2O$ (preferably boehmite), such materials including aluminum metal, aluminum nitride, aluminum oxynitride (AlON), α-$Al_2O_3$, γ-$Al_2O_3$, transitional aluminas of general formula $Al_2O_3$, boehmite (γ-AlO(OH)), pseudoboehmite ((γ-AlO(OH)).x $H_2O$ where $0 \leqq x \leqq 1$), diaspore (α-AlO(OH)), and the aluminum hydroxides ($Al(OH)_3$) of bayerite and gibbsite. Thus, aluminum oxyhydroxide particles include any finely divided materials with at least a surface shell comprising aluminum oxyhydroxide. In the most preferred embodiment, the core and shell of the particles are both of the same material comprises boehmite with a BET surface area of over 100 $m^2/g$.

In a preferred embodiment, the colloidal alumina used in the intermediate layer comprises a larger crystallite size, preferably greater than 25 nm, more preferably 30 to 60 nm than the colloidal alumina in the upper layer, preferably less than 25 nm, more preferably 15 to 25 nm, as measured by X-ray diffraction ($d_{50}$) on powdered alumina samples using X-ray diffractometers by Siemens or Philips or equivalent means.

As indicated above, the inkjet recording element comprises, over the porous ink-receiving intermediate layer, a porous image-receiving upper layer comprising greater than 50 percent, by weight of the layer, of a mixture of materials having a median particle size including (i) non-aggregated colloidal particles of one or more materials having a median particle size of under 200 nm, preferably 80 to 150 nm, more preferably 100 to 140 nm, at least 10 percent smaller, preferably at least 20 percent smaller, than the particles of the one or more second materials, and (ii) aggregated colloidal particles of one or more materials a primary particle size of 7 to 40 nm, which porous image-receiving layer is present in an amount of 1 to 10 g/m$^2$ based on dry weight coverage.

Preferably, the one or more materials in the image-receiving upper layer comprise particles of hydrated or unhydrated metallic or semi-metallic oxide, wherein the aggregated colloidal particles are fumed metallic or semi-metallic oxide. More preferably, the fumed particles are present in an amount of 25 to 75 weight percent based on total inorganic particles in the layer, most preferably fumed alumina or fumed silica, and the non-aggregated colloidal particles in the image-receiving upper layer is present in an amount of 25 to 75 weight percent based on the total inorganic particles in the layer. In such mixtures, preferably the difference between the mean aggregate particle sizes of the two types of particles is within about 25 percent, more preferably within 20 percent. Examples of useful colloidal particles include hydrated alumina (including aluminum oxyhydroxides such as boehmite), alumina, silica, aluminosilicates, titanium dioxide, zirconium dioxide, and the like.

Preferably, the non-aggregated colloidal particles comprise aluminum oxyhydroxide material or colloidal (non-aggregated) silica, as described above for the porous ink-receiving intermediate layer, other than particle size.

Metallic-oxide and semi-metallic oxide particles can be divided roughly into particles that are made by a wet process and particles made by a dry process (vapor phase process). The latter type of particles is also referred to as fumed or pyrogenic particles. In a vapor phase method, flame hydrolysis methods and arc methods have been commercially used. Fumed particles exhibit different properties than non-fumed or hydrated particles. In the case of fumed silica, this may be due to the difference in density of the silanol group on the surface. Fumed particles are suitable for forming a three-dimensional structure having high void ratio.

Fumed or pyrogenic particles are aggregates of smaller, primary particles. Although the primary particles are not porous, the aggregates contain a significant void volume, and hence are capable of rapid liquid absorption. These void-containing aggregates enable a coating to retain a significant capacity for liquid absorption even when the aggregate particles are densely packed, which minimizes the inter-particle void volume of the coating. For example, fumed alumina particles, for selective optional use in the present invention, are described in US20050170107 A1, hereby incorporated by reference.

In a preferred embodiment of the present invention, the concentration of fumed particles in the upper image-receiving layer is greater than the concentration in the ink-receiving intermediate layer, if any, relative to other inorganic particles in the layer. Preferably, the concentration of fumed particles in the upper image-receiving layer, relative to other inorganic particles in the layer, is more than twice, more preferably more than four times, that concentration of fumed particles, if any, in the ink-receiving intermediate layer.

With respect to the ink-receiving intermediate layer and the image-receiving upper layer, both being porous, they each contain interconnecting voids. The ink-receiving intermediate layer and the image-receiving upper layer will collectively be referred to as the "gloss-producing ink-receiving layers," since they contribute to the bulk of the gloss. As mentioned above, the voids in the each of the gloss-producing ink-receiving layers provide a pathway for an ink to penetrate appreciably into the base layer, thus allowing the base layer to contribute to the dry time. It is preferred, therefore, that the voids in the gloss-producing ink-receiving layer are open to (connect with) and preferably (but not necessarily) have a void size similar to the voids in the base layer for optimal interlayer absorption.

Interconnecting voids in a gloss-producing ink-receiving layer may be obtained by a variety of methods, either the ink-receiving intermediate layer and the image-receiving upper layer. In addition to the inorganic particles mentioned above, the ink-receiving intermediate layer and the image-receiving upper layer may independently contain organic particles such as poly(methyl methacrylate), polystyrene, poly (butyl acrylate), etc. as well as additional mixtures of inorganic particles that include titania, calcium carbonate, barium sulfate or other inorganic particles. Preferably, substantially all the particles in the gloss-producing ink-receiving layers have an average primary particle size of not more than 300 nm.

Suitably, the polymeric binder for the gloss-producing ink-receiving layers independently comprise, for example, a hydrophilic polymer such as poly(vinyl alcohol), polyvinyl acetate, polyvinyl pyrrolidone, gelatin, poly(2-ethyl-2-oxazoline), poly(2-methyl-2-oxazoline), poly(acrylamide), chitosan, poly(ethylene oxide), methyl cellulose, ethyl cellulose, hydroxyethyl cellulose, hydroxypropyl cellulose, etc. Other binders can also be used such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like.

The particle-to-binder weight ratio of the particles and optional binder employed in the porous gloss-producing ink-receiving layer can range between about 100:0 and 60:40, preferably between about 100:0 and about 90:10. In general, a layer having particle-to-binder ratios outside the range stated will usually not be sufficiently porous to provide good image quality. In a preferred embodiment of the invention, the volume ratio of the particles to the polymeric binder in the gloss-producing ink-receiving layer is from about 1:1 to about 15:1.

Other additives that optionally can be included in the gloss-producing ink-receiving layers include pH-modifiers like nitric acid, cross-linkers, rheology modifiers, surfactants, UV-absorbers, biocides, lubricants, dyes, dye-fixing agents or mordants, optical brighteners, and other conventionally known additives.

The inkjet recording element can be specially adapted for either pigmented inks or dye-based inks, or designed for both. In the case of pigment based inks, the image-receiving upper layer can function as a pigment-trapping layer. In the case of dye-based inks both the upper and intermediate layers, or an upper portion thereof, may contain the image, depending on effectiveness of any mordants in the layers.

The term "pigment-trapping layer" is used herein to mean that, in use, preferably at least about 75% by weight, more preferably substantially all, of the pigment colorant in the inkjet ink composition used to print an image remains in the pigment-trapping layer.

A dye mordant can be employed in any of the ink-retaining layers, but usually at least the image-receiving upper layer and optionally also the intermediate layer. The mordant can be any material that is substantive to the inkjet dyes. The dye mordant removes dyes from dye-based ink received from the ink-retaining layer and fixes the dye within the one or more dye-trapping layers. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium)propyl chloride. In a preferred embodiment, the cationic mordant is a quaternary ammonium compound.

In order to be compatible with the mordant, both the binder and the polymer in the layer or layers in which it is contained should be either uncharged or the same charge as the mordant. Colloidal instability and unwanted aggregation could result if a polymer or the binder in the same layer had a charge opposite from that of the mordant.

In one embodiment, the porous upper image receiving layer may independently comprise dye mordant in an amount ranging from about 2 parts to about 40 percent by weight of the layer, preferably 10 to 25 percent, more preferably about 15 parts by weight. The upper layer preferably is the layer containing substantially the highest concentration and amount of polymeric mordant.

The support for the coated ink-retaining layers may be selected from plain papers, preferably raw (uncoated paper). Thus, resin-coated papers are to be avoided. The thickness of the support employed in the invention can be from about 12 to about 500 μm, preferably from about 75 to about 300 μm.

If desired, in order to improve the adhesion of the base layer to the support, the surface of the support may be corona-discharge-treated prior to applying the base layer to the support.

Since the inkjet recording element may come in contact with other image recording articles or the drive or transport mechanisms of image-recording devices, additives such as surfactants, lubricants, matte particles and the like may be added to the inkjet recording element to the extent that they do not degrade the properties of interest.

The present inkjet recording element, or a sheet material that is divided into separate elements, may be made by various coating methods which may include, but are not limited to, wound wire rod coating, slot coating, slide hopper coating, gravure, curtain coating and the like. Some of these methods allow for simultaneous coatings of two or more layers, which is preferred from a manufacturing economic perspective.

The image receiving material is preferably manufactured by a process comprising the steps of:

a) providing an absorbent support, b) coating upon at least one surface of said absorbent support, by a post-metering method, a first coating composition comprising inorganic particles, binder, and surfactant, to provide a base layer on the support, wherein the first coating composition is 40 to 80 percent by weight solids, preferably 50 to 80 percent solids, wherein the base layer comprises greater than 50 percent, by weight of the solids, of particles of one or more base-layer materials having an average particle size of 0.4 to 5 micrometers, wherein said base layer is coated in one coating pass at a dry weight coverage of at least 25 $g/m^2$;

c) drying the coating for the base layer;

d) coating over the base layer, by a pre-metered coating method, at least two additional coating compositions, having a solids concentration at least 10 percent less than the first coating composition, the two additional coating compositions independently having under 60 percent solids, preferably between 25 and 40, by weight of the coating composition, including at least a second coating composition for an intermediate layer and a third coating composition for an upper layer, wherein the second and third coating compositions are different and independently comprise greater than 50 percent, by weight of the solids, of particles of one or more additional materials having an average particle size of under 300 nm, which additional materials are selected from hydrated or unhydrated metallic oxides and silicon oxides, the first and second coating compositions also comprising binder, wherein the dry weight coverage of the intermediate layer, is at least 15 $g/m^2$, the dry weight coverage of the upper layer is 1 to 10 $g/m^2$, and the total dry weight coverage of the base layer, the intermediate layer, and the upper layer is 61 to 130 $g/m^2$;

e) drying the coatings for the additional layers;

f) calendering the coatings of step (e) to a 20-degree gloss of at least 15 Gardner units.

In a preferred embodiment, the dried base layer is also calendered between steps (c) and (d).

By the term "post-metering method" is meant a method in which the coating composition is metered after coating, by removing excess material that has been coated.

By the term "pre-metering method," also referred to as direct metering method, is meant a method in which the coating composition is metered before coating, for example, by a pump.

Pre-metered methods can be selected from, for example, curtain coating, extrusion hopper coating, slide hopper coating, and the like.

In a preferred embodiment, the two additional layer are simultaneously coated, preferably by curtain coating, and the base layer is rod coated. In one embodiment, after step (b), all the subsequent layers, including the at least two additional coating compositions are coated in one coating pass.

Optional other layers, including subbing layers, overcoats, further intermediate layers between the base layer and the upper layer, etc. may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of two or more layers, which is preferred from a manufacturing economic perspective. Preferably, the base layer and the intermediate layer are the only two layers over 5 micrometers thick.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. If dyes are used in such compositions, they are typically water-soluble direct or acid type dyes. Such liquid compositions have been described extensively in the prior art including, for example, U.S. Pat. Nos. 4,381,946; 4,239,543; and 4,781,758.

Typically the colorants used in inkjet printing are anionic in character. In dye based printing systems, the dye molecules contain anionic moieties. In pigment based printing systems, the dispersed pigments are functionalized with anionic moieties. Colorants must be fixed near the surface of the inkjet receiver in order to provide the maximum image density. In the case of pigment based printing systems, the inkjet receiver is designed with the optimum pore size in the top layer to provide effective trapping of ink pigment particles near the surface. Dye-based printing systems require a fixative or mordant in the top layer of the receiver. Polyvalent metal ions and insoluble cationic polymeric latex particles provide effective mordants for anionic dyes. Both pigment and dye based printing systems are widely available. For the convenience of the user, a universal porous inkjet receiver will comprise a dye fixative in the topmost layer.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

Another aspect of the invention relates to an inkjet printing method comprising the steps of: (a) providing an inkjet printer that is responsive to digital data signals; (b) loading the inkjet printer with the inkjet recording element described above; (c) loading the inkjet printer with a pigmented inkjet ink; and (d) printing on the inkjet recording element using the inkjet ink in response to the digital data signals.

In a preferred embodiment, the inkjet ink composition is applied onto the inkjet recording element at a rate of at least $5.0\times10^{-4}$ mL/cm$^2$/sec without loss of image quality. This ink flux corresponds to printing a photograph at an addressable resolution of 1200 by 1200 pixels per inch with an average ink volume of 10.35 picoliters (pL) per pixel in 42 seconds, wherein the printing of a given pixel by multiple coating passes is complete in less than 4 seconds.

The following examples further illustrate the invention.

EXAMPLE 1

A multilayer inkjet receiver according to the present process was prepared as follows.

A coating solution for a base layer was prepared by mixing 0.335 dry g of Colloid 211 sodium polyacrylate (Kemira Chemicals) as a 43% solution and 145 g of water. To the mixture was added 25.44 dry g of silica gel (IJ-624, Crosfield Ltd.) while stirring, 148.3 dry g of precipitated calcium carbonate (Albagloss-S®, Specialty Minerals Inc.) as a 69% solution, 4.09 dry g of a poly(vinyl alcohol) (Celvol 325, Air Products and Chemicals Inc.) as a 10% solution, an additional 22.89 dry g of silica gel (IJ-624, Crosfield Ltd.), and 25 dry g of styrene-butadiene latex (CP692NA®, Dow Chemicals) as a 50% solution. The silica gel was added in two parts to avoid gelation.

Accordingly, the base layer was made up of the sodium polyacrylate, silica gel, precipitated calcium carbonate, poly (vinyl alcohol), and styrene-butadiene latex in a weight ratio of 0.15:21.30:65.45:1.80:11.30 at 45% solids.

The base layer coating solution was rod-coated on a base paper, basis weight 179 g/m$^2$, and dried by forced air. The thickness of the dry base coating was 30 μm and its weight was 32.3 g/m$^2$.

A coating solution for the intermediate layer was prepared by combining hydrated alumina (Catapal® 200, Sasol Corp.), poly(vinyl alcohol) (Gohsenol® GH-23, Nippon Gohsei Co.), Cartabondt GH (Clariant Corp.) glyoxal crosslinker and boric acid in a ratio of 95.38:4.25:0.25:0.13 to give an aqueous coating formulation of 33% solids by weight.

A coating solution for the upper layer was prepared by combining hydrated alumina (Dispal® 14N4-80, Condea Vista Co.), fumed alumina (Cab-O-Sperse® PG003, Cabot Corp.), poly(vinyl alcohol) (Gohsenol® GH-23, Nippon Gohsei Co.), cationic mordant, Cartabond® GH glyoxal (Clariant Corp.) and boric acid in a ratio of 36.4:41.58:5.23:15.72:0.25:0.13 to give an aqueous coating formulation of 21% solids by weight. Surfactants Zonyl® FSN (DuPont Co.) and Olin® 10G (Olin Corp.) were added in small amounts as coating aids.

The intermediate and upper layers were curtain-coated on top of the base layer at a viscosity, respectively, of 75 cP and 20 cP (centipoise) at a temperature of 40° C. The coating was then dried by forced air to yield a three-layer recording element. The thickness of the mid-layer was 35 μm or 37.7 g/m$^2$. The thickness of the overcoat-layer was 2 μm or 2.15 g/m$^2$. The coated material was calendered at a pressure of 700 PLI, including two passes through the nip.

EXAMPLE 2

Samples according to the formula above were prepared by a small-scale (laboratory) bead coating machine in three separate coating passes, with drying and rewinding between coating passes. (For the purpose of obtaining exploratory laboratory data with respect to gloss, the larger scale coating method of the present invention was not used, in contrast to Example 1). The D-min gloss was measured at 20, 60 and 85 degrees. The results are shown in Table 1 below

TABLE 1

| | | Calendered Gloss | | |
|---|---|---|---|---|
| Sample | Description | 20 degree | 60 degree | 85 degree |
| 1 (inv) | Example 1 | 29.5 | 60.8 | 91.8 |
| C-2 (comp) | No base layer | 13 | 52.3 | 77.4 |
| C-3 (comp) | No upper layer | 18.3 | 47.5 | 89 |
| C-4 (comp) | No intermediate layer | 3.2 | 22 | 73.1 |

The results in Table 1 above demonstrate significant loss of gloss when any one of the upper, mid and base layers is omitted. Replacing the base layer with an equivalent additional weight of mid layer would result in unacceptable cracking.

EXAMPLE 3

Coatings were prepared according to the formula of coating number 1 in Table 1, except that the ratio of fumed and colloidal alumina in the top layer was varied. The D-min gloss was measured at 20, 60 and 85 degrees. The samples were printed with an Epson® R200 printer. The densities of primary, secondary and black colors were measured. The results are shown in Table 2 below.

TABLE 2

| | Description | Calendered Gloss | | | Density (on EPSON R200) | | | |
|---|---|---|---|---|---|---|---|---|
| Sample | Ratio fumed to colloidal | 20 degree | 60 degree | 85 degree | Primary Average | Secondary Average | Black Average | Average |
| C-2 | 100/0 | 28.3 | 57.9 | 92.8 | 1.62 | 1.43 | 1.76 | 1.60 |
| 3 | 75/25 | 30 | 59.5 | 92.9 | 1.71 | 1.52 | 1.87 | 1.70 |
| 4 | 50/50 | 31.8 | 60.6 | 93.1 | 1.78 | 1.61 | 1.99 | 1.79 |
| 5 | 25/75 | 33.7 | 60.8 | 92.9 | 1.81 | 1.68 | 2.11 | 1.87 |
| C-6 | 0/100 | 36.5 | 62.8 | 93.7 | 1.83 | 1.75 | 2.27 | 1.95 |

The results of the gloss measurements show that the gloss of the comparative element C-2 is inferior to that of the inventive elements 3, 4, and 5. Furthermore, the density measurements with dye-based inks show that the comparative element is inferior in density to the inventive elements 3, 4, and 5.

These base-layer-coated papers were evaluated for ink absorption using the Bristow test method, described in ASTM test method D 5455. Fifty microliters of control ink, comprising 3 parts by weight BAYSCRIPT Cyan BA cyan dye (Bayer Chemical), 12 parts by weight diethylene glycol, 0.5 parts by weight SURFYNOL 465 (Air Products), 0.02 parts by weight PROXEL GXL biocide (Avecia), 0.3 parts by weight triethanolamine at 10%, and 84.18 parts by weight water, was measured into the application hopper. Bristow ink absorption values for each of the base-layer-coated papers were measured at a wheel rotational speed of 0.5 mm/s and 0.1 MPa hopper pressure. Two runs were conducted at each of three contact times. The results for each pair of runs were averaged and are shown in Table 3.

TABLE 3

| | Description | Bristow number (ml/m$^2$) | | |
|---|---|---|---|---|
| Sample | Ratio fumed to colloidal | 2000 ms | 800 ms | 400 ms |
| C-2 | 100/0 | 42.3 | 33.7 | 33.9 |
| 3 | 75/25 | 41.7 | 34.7 | 30.9 |
| 4 | 50/50 | 41.1 | 35.2 | 30.7 |
| 5 | 25/75 | 42.1 | 34.3 | 31.4 |
| C-6 | 0/100 | 38.9 | 29.9 | 27.9 |

The results of the Bristow test demonstrate that the comparison recording element C-6 without fumed alumina has inferior ink absorption compared to the examples of the invention containing at least 25% fumed alumina in the upper ink-receiving layer, recording elements 2, 3, and 4.

The invention has been described with reference to a preferred embodiment. However, it will be appreciated that variations and modifications can be effected by a person of ordinary skill in the art without departing from the scope of the invention.

The invention claimed is:

1. An inkjet recording element comprising, in order over an absorbent support:

(a) a porous base layer comprising a polymeric binder and at least 80 percent by weight of inorganic particles, wherein at least 60% by weight of the inorganic particles comprises precipitated calcium carbonate having a particle size of 0.4 to 5 micrometers;

(b) a porous ink-receiving intermediate layer comprising at least 80 percent by weight of inorganic particles of hydrated or unhydrated alumina, the median primary particle size of which is between 150 and 250 nm, wherein the concentration of fumed alumina in the intermediate layer, if present, is less than the concentration of fumed alumina in the upper layer, relevant to the inorganic particles in each layer; and (c) a porous image-receiving upper layer comprising at least 80 percent, by weight of total inorganic particles, of an admixture of fumed alumina particles and aluminum oxyhydroxide particles, wherein the latter particles have a median particle size of from about 90 to 150 nm and the former particles have a median secondary particle size of under 200 nm and primary average particle size of 7 to 40 nm;

wherein, based on dry weight coverages, the base layer is present in an amount of 25 g/m$^2$ to 60 g/m$^2$, the intermediate layer, optionally divided into sub-layers, is present in an amount of 15 g/m$^2$ to 60 g/m$^2$, the upper layer is present in an amount of 1 to 10 g/m$^2$;

and wherein the unprinted inkjet recording element exhibits a 20-degree gloss of at least 15 Gardner gloss units.

2. The element of claim 1 wherein, based on dry weight coverages, the base layer is present in an amount of between 30 and 50 g/m$^2$, the ink-receiving intermediate layer is present in an amount between 30 and 50 g/m$^2$, the image-receiving upper layer is present in an amount of 1 to 5 g/m$^2$, and the total dry weight coverage of the base layer, the intermediate layer, and the upper layer is 61 to 105 g/m$^2$.

3. The element of claim 1 wherein the 60-degree gloss of the unprinted inkjet recording element is at least 40 Gardner gloss units.

4. The element of claim 1 wherein the 20-degree gloss of the unprinted inkjet recording element is at least 20 Gardner gloss units and the 60-degree gloss is at least 50 Gardner gloss units.

5. The element of claim 1 wherein the 20-degree gloss of the unprinted inkjet recording element is greater than 25 Gardner gloss units and the 60-degree gloss is greater than 55 Gardner gloss units.

6. The inkjet recording element of claim 1 wherein the precipitated calcium carbonate comprises a material having a morphology selected from the group consisting of scalenohedral, prismatic, acicular, rhombohedral, and combinations thereof.

7. The inkjet recording element of claim 6 wherein the base layer comprises an admixture of two different morphologies of precipitated calcium carbonate.

8. The inkjet recording element of claim 7 wherein the base layer comprises an admixture of scalenohedral in combination with acicular and/or prismatic precipitated calcium carbonate.

9. The element of claim 1 wherein the base layer further comprises particles of silica gel in an amount up to 40 percent by weight based on the total inorganic particles in the base layer.

10. The element of claim 1 wherein the image-receiving layer comprises substantially all of the polymeric mordant in the inkjet recording element, in an amount of between 10 to 25 percent by weight of the layer.

11. The element of claim 1 wherein the concentration of fumed particles in the upper image-receiving layer, relative to other inorganic particles in the layer, is more than twice that concentration of fumed particles, if any, in the ink-receiving intermediate layer.

12. The element of claim 1 wherein the base layer comprises less than 15 weight percent binder.

13. The inkjet recording element of claim 1 wherein the base layer comprises both a hydrophilic and hydrophobic binder.

14. The inkjet recording element of claim 1 wherein the binder in the base layer comprises poly(vinyl alcohol).

15. The inkjet recording element of claim 1 wherein the base layer further comprises crosslinker for the poly(vinyl alcohol).

16. The inkjet recording element of claim 1 wherein the base layer further comprises polymeric latex.

17. The inkjet recording element of claim 16 wherein the latex comprises styrene-butadiene polymer.

18. The inkjet recording element of claim 1 wherein the base layer further comprises dispersant.

19. The inkjet recording element of claim 18 wherein the dispersant in the base layer comprises polyacrylate.

20. The element of claim 1 wherein the intermediate layer and upper layer each independently comprises 2 to 10 weight percent binder and wherein the volume ratio of the particles to the polymeric binder is from about 1:1 to about 15:1.

21. The element of claim 1, wherein at least the image-receiving upper layer comprises mordant.

22. The element of claim 21, wherein the mordant comprises cationic polymeric latex particles.

23. The element of claim 22, wherein the cationic polymeric latex particles are essentially absent from the base layer.

24. The inkjet recording element of claim 1 wherein the support is raw paper.

25. The inkjet recording element of claim 1 consisting essentially of the base layer, intermediate layer, and the image-receiving layer, wherein the base layer and the intermediate layer are the only two layers over 5 micrometers.

* * * * *